United States Patent [19]

Su

[11] Patent Number: 5,046,772

[45] Date of Patent: Sep. 10, 1991

[54] DOOR HANDLE MEANS SUITABLE FOR MOUNTING SLIM LEVER HANDLE

[76] Inventor: Frank Su, P.O. Box 55-1670, Taipei, Taiwan

[21] Appl. No.: 592,540

[22] Filed: Oct. 2, 1990

[51] Int. Cl.[5] ..... E05B 3/06

[52] U.S. Cl. ..... 292/336.5; 292/DIG. 53

[58] Field of Search ..... 292/357, 358, 348, 336.5, 292/DIG. 53, DIG. 54, 347

[56] References Cited

U.S. PATENT DOCUMENTS

| | | | |
|---|---|---|---|
| 555,354 | 2/1896 | Worsey | 292/165 |
| 1,089,435 | 3/1914 | Page | 292/348 |
| 1,135,731 | 4/1915 | Smyser | 292/348 |
| 1,263,880 | 4/1918 | Glossop | 292/347 |
| 1,947,282 | 2/1934 | Theis | 292/347 |
| 2,080,174 | 1/1936 | Hart et al. | 292/358 |
| 3,156,495 | 11/1964 | Holden | 292/DIG. 38 |
| 4,453,753 | 6/1984 | Fayerman et al. | 292/357 |

FOREIGN PATENT DOCUMENTS

| | | | |
|---|---|---|---|
| 1236000 | 6/1960 | France | 292/336.5 |

*Primary Examiner*—Eric K. Nicholson
*Assistant Examiner*—Darnell M. Boucher

[57] ABSTRACT

A door handle device includes: a restoring device mounted on a washer secured to a door, a spindle laterally adjustably mounted in the restoring device, and a lever handle having a handle sleeve fixed on an outer end portion of the spindle rotatably driving the spindle for operating a latch bolt for opening the door, in that the restoring device is provided for restoring the lever handle once depressed by a door opener and for adjustably securing the spindle on the device with respect to a door thickness in order for a connection of the spindle to a latch bolt mechanism operatively retracting or extending the latch bolt. The spindle is directly secured to the door handle so that a handle sleeve formed on a central portion of the door handle may be made as slim as possible.

1 Claim, 5 Drawing Sheets

DOOR HANDLE MEANS SUITABLE FOR MOUNTING SLIM LEVER HANDLE

BACKGROUND OF THE INVENTION

A conventional door knob K rotatably mounted on a door as shown in FIG. 1 always includes a handle portion H of large diameter capable of being jacketed on a hollow tube T having a tensioning spring S mounted in the tube T for resiliently urging the spindle P inwardly in order to actuate a latch bolt L of a door lock mounted in the door D.

For retaining the spring S inside the hollow tube T, the tube T can not be made as slim solid rod for minimizing its volume so that a lever handle of slim or fine diameter can not be mounted on the large hollow tube, thereby limiting the uses of the conventional door knob.

The present inventor has found the drawbacks of a conventional door knob and invented the present door handle means suitable for mounting a slim door handle.

SUMMARY OF THE INVENTION

The object of the present invention is to provide a door handle mechanism including a restoring device mounted on a washer secured to a door, a spindle laterally adjustably mounted in the restoring device, and a lever handle having a handle sleeve fixed on an outer end portion of the spindle rotatably driving the spindle for operating a latch bolt for opening the door, in that the restoring device is provided for restoring the lever handle once depressed by a door opener and for adjustably securing the spindle on the device with respect to a door thickness in order for a connection of the spindle to a latch bolt mechanism operatively retracting or extending the latch bolt.

DETAILED DESCRIPTION

Figure 1:
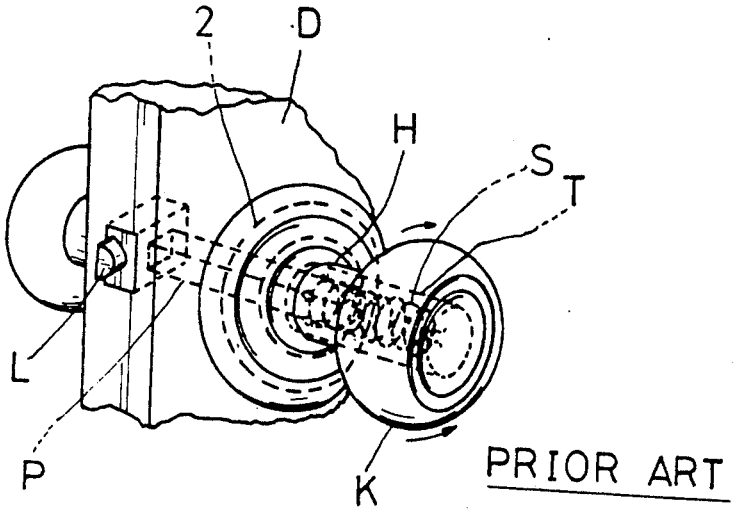
FIG. 1 is an illustration showing a prior art of a conventional knob.

As shown in FIGS. 2–5, the present invention comprise: a restoring means 1, a fixing washer 2, a spindle 3, and a handle means 4.

The restoring means 1 includes: a spring holder 11 generally formed as a shallow cylindrical shape having a spindle hole 10 for securing the spindle 3 therethrough, a restoring spring 12 held in the holder 11 having its two spring ends 121 radially retained and separated by an arcuate extension 111 circumferentially formed in a periphery of the holder 11 and also protruding outwardly from said holder 11 to be retained on two limiting stems 23 radially formed on the fixing washer 2, a spindle sleeve 13 secured and adjacent to the spring holder 11, a ring groove 15 annularly formed in the restoring means 1 between the spring holder 11 and the spindle sleeve 13 for embedding a retainer ring 16 in the groove 15 for rotatably securing the restoring means 1 on the fixing washer 2. The groove 15 is formed beyond the spring holder 11 with a distance or space generally equal to the thickness of the washer 2.

The spindle sleeve 13 is formed with a screw hole 131 therein so that a set screw 14 may be inserted and fixed in the hole 131 for firmly securing the spindle 3 on the sleeve 13. The depth of the spindle 3 fixed on the sleeve 13 and the washer 2 can be optionally adjusted with respect to a thickness of the door 5 so that an inner end portion 31 of the spindle 3 may be snugly connected to a latch bolt mechanism 61 for retracting or extending a latch bolt 6 formed in a lock hole 51 in the door 5.

The fixing washer 2 generally circular shaped includes an annular perimeter edge 21 engageably secured to the lock hole 51 of the door 5, a plurality of screw holes 22 for fixing bolt (not shown) therein for securing the washer 2 in the door 5, and two limiting stems 23 separately formed on the washer 2 for limiting the spring ends 121 of restoring spring 12. The washer 2 is formed with a central hole 20 for passing the sleeve 13 of the restoring means 1 for rotatably mounting the restoring means 1 on the washer 2.

Figure 2:
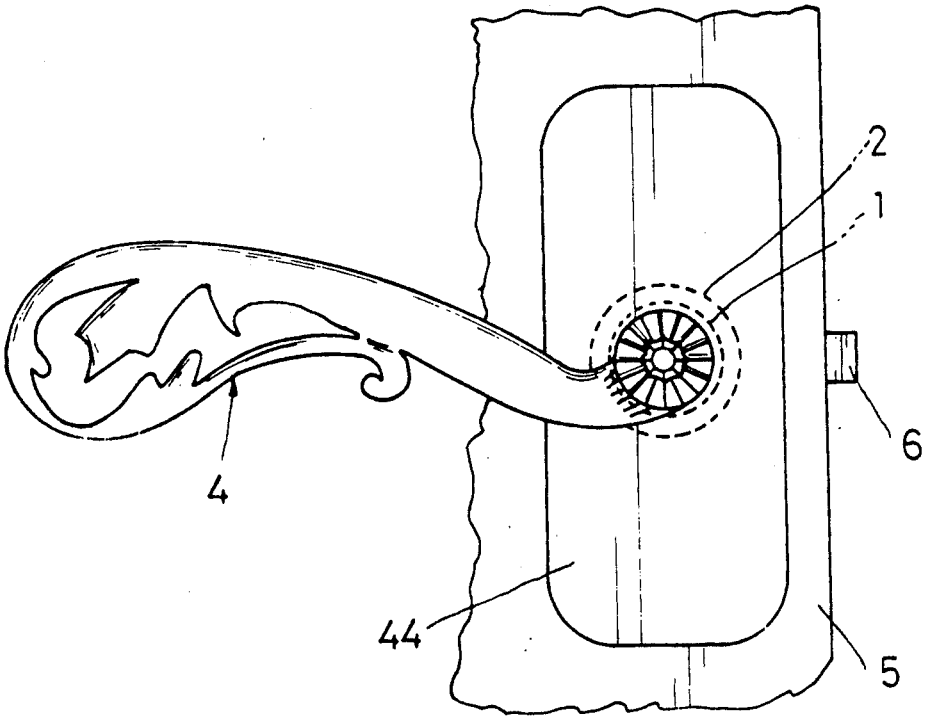
FIG. 2 is a front view illustration of the present invention.
Figure 3:
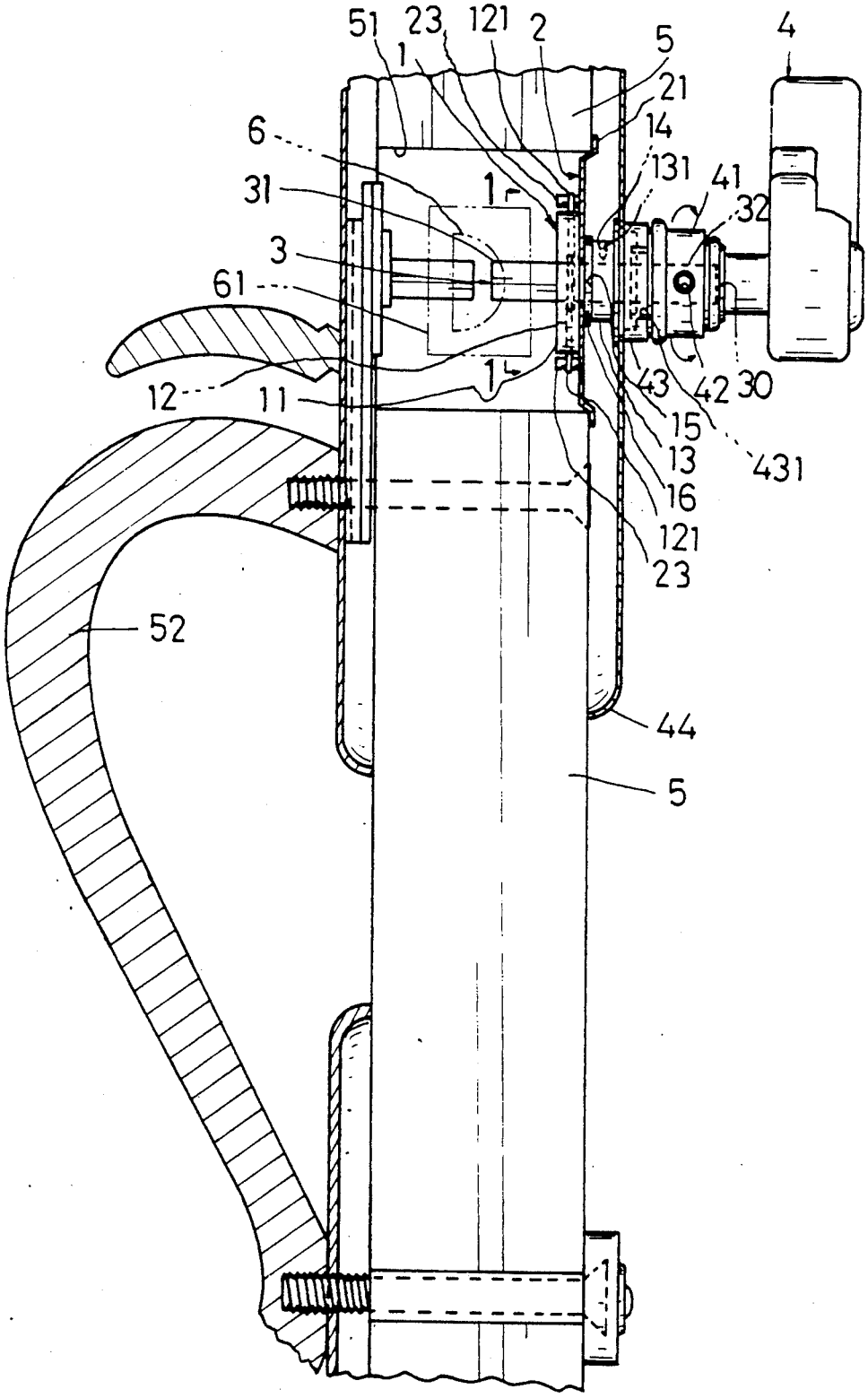
FIG. 3 is a side view illustration of the present invention.
Figure 4:
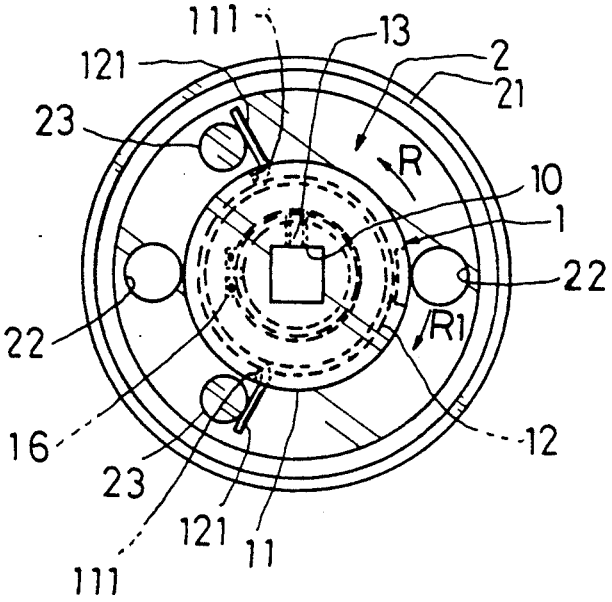
FIG. 4 is a rear side view of a restoring means of the present invention as viewed from 1—1 direction of FIG. 3.
Figure 5:
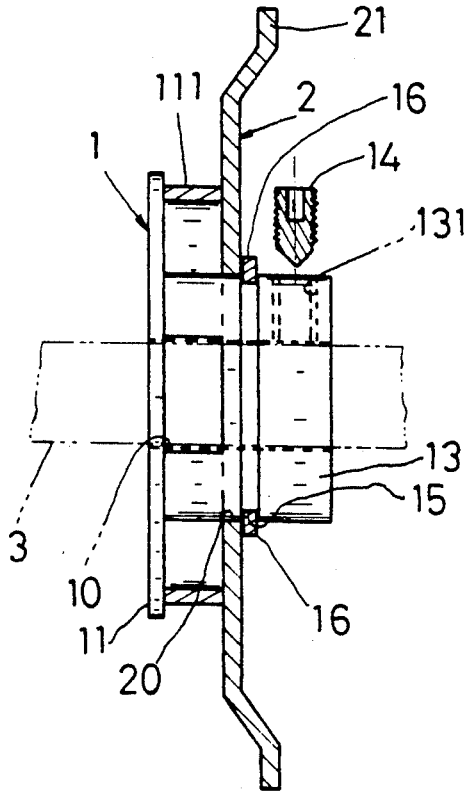
FIG. 5 is a side view of the restoring means mounted with a washer and a spindle in accordance with the present invention.
Figure 8:
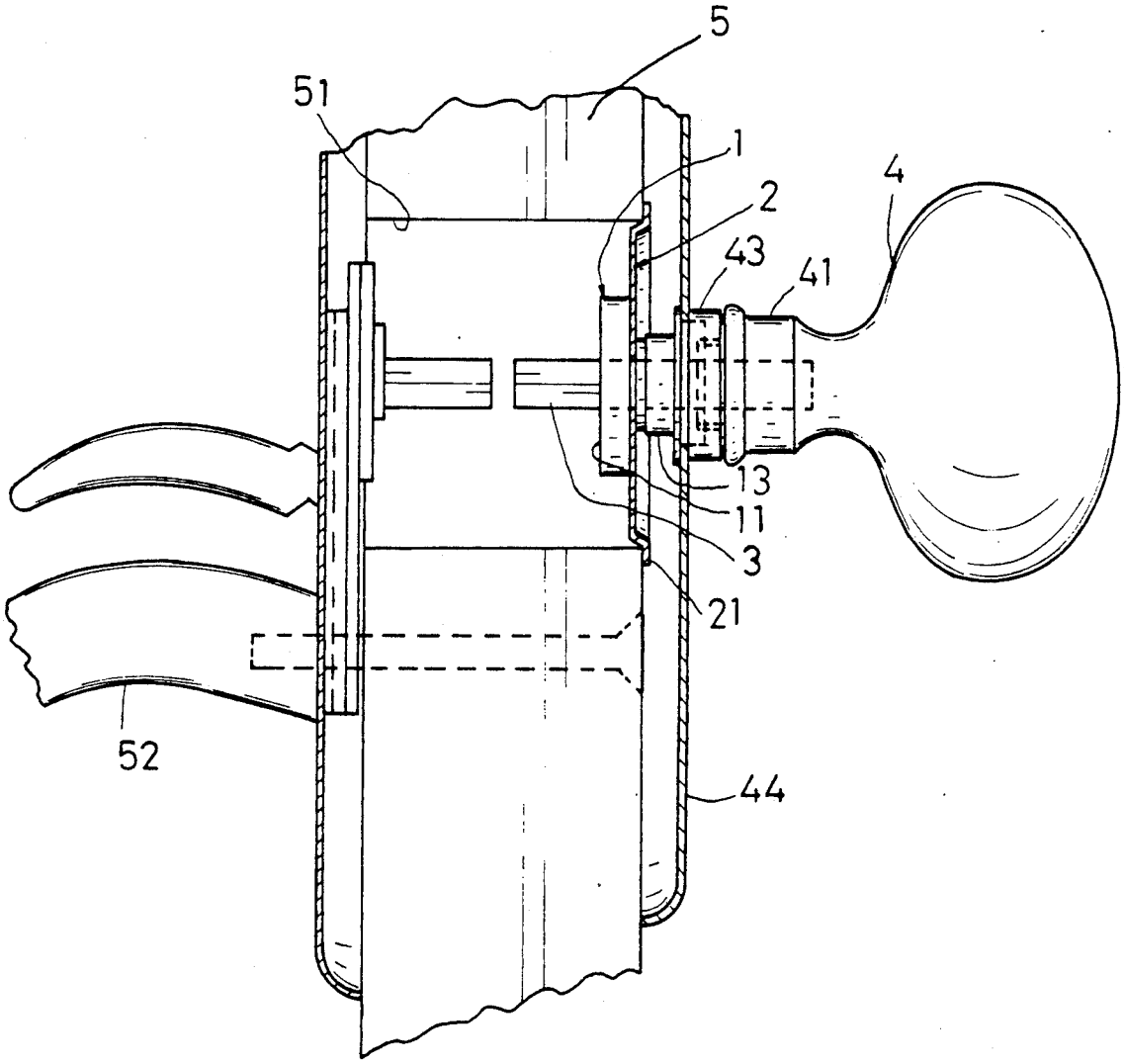
FIG. 8 shows another preferred embodiment of the present invention.

The handle means 4 may be selected from a lever handle as shown in FIG. 2 and includes: a handle sleeve portion 41 secured on an outer end portion 32 of the spindle 3 by another set screw 42, a bearing washer 43 for rotatably smoothly supporting the sleeve portion 41 of the handle means 4 and for rotatably passing the spindle 3 through a central hole 431, and a base plate 44 secured on the door 5 for mounting the bearing washer 43 thereon. The handle means 4 may also be substituted with a door knob a shown in FIG. 8. The restoring means 1, the washer 2 and an inner portion of the spindle 3 are formed in the lock hole 51 and covered by the base plate 44.

The door 5 may be mounted with any conventional lock (not shown) and may include an outer handle 52 for opening the door 5 outside the door 5.

The present invention may be suitably modified by those skilled in the art without departing from the scope and spirit of this invention.

Figure 6:
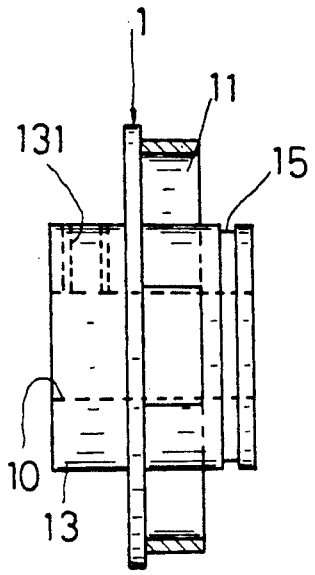
FIG. 6 shows another preferred embodiment of the restoring means of the present invention.
Figure 7:
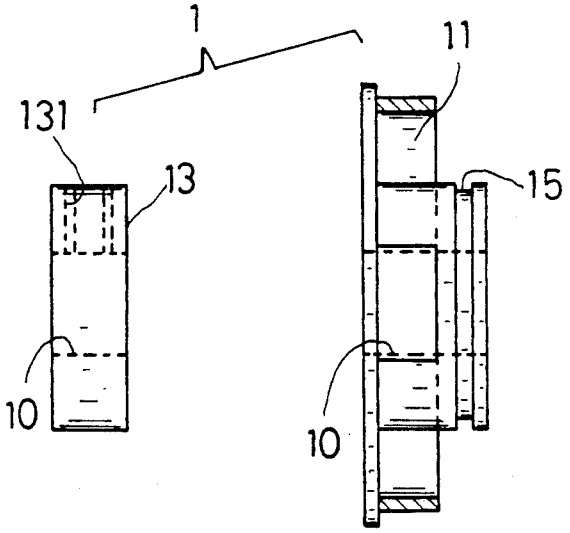
FIG. 7 shows still another preferred embodiment of the restoring means of the present invention.

The restoring means 1 may be modified to be as shown in FIG. 6 to "move" the sleeve 13 inwardly to be positioned on an inner side of the spring holder 11, or may be separated into two parts, that are, one spring holder 11 and a sleeve 13 as shown in FIG. 7.

The spindle 3 may be directly secured to a handle 4 so that a handle sleeve portion 41 of any kind of handle 4 may be made as slim as possible for reducing the volume of a central sleeve portion of the handle and also for enhancing decorative or esthetic effect, therefore being superior to a conventional knob secured on a hollow tube T especially as shown in FIG. 1.

When rotating handle 4 to rotate the restoring means 1 in direction R, the upper spring end 121 is retained on the upper stem 23, a lower edge of the arcuate extension 111 of the spring holder 11 will urge the lower spring end 121 also in direction R to accumulate the elastic force of the restoring spring 12 so that upon the releasing of the handle 4, the restoring means 1 and handle 4 will be restored (direction R1) by spring 12 to their original position. This is the operation principle of the restoring means 1 of the present invention.

I claim:

1. A door handle means comprising:

a restoring means including a spring holder having a restoring spring held therein with two spring ends radially separated and retained on an arcuate extension circumferentially formed in said spring holder, and a spindle sleeve secured and adjacent to said spring holder for adjustably securing a spindle in a spindle hole formed through said restoring means;

a fixing washer secured in a door for rotatably mounting said restoring means thereon, having two limiting stems formed on said washer respectively retaining two spring ends of said restoring spring radially protruding outwardly from said spring holder of said restoring means;

said spindle adjustably secured in said spindle sleeve of said restoring means by a set screw inserted in said spindle sleeve with respect to a thickness of the door in order for connecting an inner end portion of said spindle to a latch bolt mechanism of a latch bolt for retracting or extending the latch bolt for door opening or closing operation; and a handle means selected from a lever handle and a knob having a handle sleeve portion secured on an outer end portion of said spindle, whereby upon a depression or rotation of said handle means, one spring end of said restoring spring is retained on one said limiting stem and the other spring end as retained on the arcuate extension will be rotated to store an elastic force of said restoring spring, and said spindle will be rotated for retracting the latch bolt for opening the door, and upon a releasing of the depression or rotation of the handle means, the restoring spring in said restoring means will restore said spindle to counter rotate said handle means to its original position;

the improvement which comprises:

said restoring means including a ring groove annularly formed therein between said spring holder and said spindle sleeve, having a retainer ring embedded in said ring groove for rotatably mounting said restoring means in said fixing washer.

* * * * *